US009131760B1

(12) United States Patent
Townsend

(10) Patent No.: US 9,131,760 B1
(45) Date of Patent: Sep. 15, 2015

(54) MOBILIZED HAIR-DRYING ASSEMBLY

(71) Applicant: Sherrie Townsend, Childersburg, AL (US)

(72) Inventor: Sherrie Townsend, Childersburg, AL (US)

( * ) Notice: Subject to any disclaimer, the term of this patent is extended or adjusted under 35 U.S.C. 154(b) by 182 days.

(21) Appl. No.: 13/954,033

(22) Filed: Jul. 30, 2013

(51) Int. Cl.
*A45D 20/00* (2006.01)
*A45D 20/34* (2006.01)

(52) U.S. Cl.
CPC ..... *A45D 20/34* (2013.01)

(58) Field of Classification Search
CPC ..... F26B 19/00; F26B 21/00; F26B 21/06; A45D 20/00; A45D 20/18; A45D 20/28; A62B 7/00; A61F 9/00; A61F 9/02
USPC ..... 34/96, 97, 98; 392/384, 385; 128/202.27, 205.25; 2/171.3, 426; 132/233, 247
See application file for complete search history.

(56) References Cited

U.S. PATENT DOCUMENTS

| | | | | | |
|---|---|---|---|---|---|
| 3,108,862 | A | * | 10/1963 | Toulmin | 34/99 |
| 3,377,715 | A | * | 4/1968 | Hubner | 34/99 |
| 3,946,498 | A | * | 3/1976 | Waters et al. | 34/99 |
| 4,301,601 | A | * | 11/1981 | Carr | 34/283 |
| 4,361,966 | A | * | 12/1982 | Downey | 34/99 |
| 4,384,411 | A | * | 5/1983 | Stiegler et al. | 34/99 |
| 5,235,760 | A | * | 8/1993 | Bastien | 34/99 |
| 5,342,411 | A | * | 8/1994 | Maxted et al. | 607/107 |
| 5,829,157 | A | * | 11/1998 | Gittens et al. | 34/99 |
| 5,887,357 | A | * | 3/1999 | McNair | 34/99 |
| 6,964,116 | B2 | * | 11/2005 | Kroll et al. | 34/96 |
| 7,096,597 | B1 | * | 8/2006 | Zellous | |
| 7,694,353 | B2 | * | 4/2010 | Weston | |
| 8,156,570 | B1 | * | 4/2012 | Hockaday | |
| 2005/0132468 | A1 | * | 6/2005 | Lundgren | 2/171.3 |
| 2005/0171457 | A1 | * | 8/2005 | Yang | 601/11 |
| 2008/0168594 | A1 | * | 7/2008 | Bratton | |

FOREIGN PATENT DOCUMENTS

| | | | | |
|---|---|---|---|---|
| DE | 33 30 743 | A1 | * | 3/1984 |
| EP | 1 974 628 | A1 | * | 10/2008 |
| GB | 2412314 | A | * | 9/2005 |
| GB | 2 412 314 | A | * | 2/2006 |
| JP | 2000024100 | A | * | 7/1998 |
| KR | 101256770 | B1 | * | 4/2013 |

* cited by examiner

*Primary Examiner* — Stephen M Gravini

(57) ABSTRACT

The mobilized hair-drying assembly includes a helmet member with motorized fan housing rigidly affixed to an exterior surface, and which propels accelerated air into the interior of the helmet member in order to dry hair of an end user positioned therein. An elastic member extends around an opening of the helmet member in order to provide an air-tight seal between a head of the end user and the helmet member. The helmet member includes a plurality of vent holes that enable the accelerated air to exit only after circulating across the hair of the end user. The motorized fan housing being positioned on a rear, exterior surface of the helmet member includes a heating coil that is selectively operated to introduce heated and accelerated air into the helmet member.

13 Claims, 4 Drawing Sheets

MOBILIZED HAIR-DRYING ASSEMBLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hair dryers, more specifically, a fully mobilized hair dryer assembly.

SUMMARY OF THE INVENTION

An embodiment of the disclosure meets the needs presented above by generally comprising a helmet member with motorized fan housing rigidly affixed to an exterior surface, and which propels accelerated air into the interior of the helmet member in order to dry hair of an end user positioned therein. An elastic member extends around an opening of the helmet member in order to provide an air-tight seal between a head of the end user and the helmet member. The helmet member includes a plurality of vent holes that enable the accelerated air to exit only after circulating across the hair of the end user. The motorized fan housing being positioned on a rear, exterior selectively operated to introduce heated and accelerated air into the helmet member. A set of ear protectors may be included in order to protect the ears of the end user. A motorized fan located inside of the motorized fan housing is powered via at least one battery.

An object of the invention is to provide a device that is able to dry one's hair, and which is completely hands-free as well as portable.

These together with additional objects, features and advantages of the mobilized hair-drying assembly will be readily apparent to those of ordinary skill in the art upon reading the following detailed description of presently preferred, but nonetheless illustrative, embodiments of the mobilized hair-drying assembly when taken in conjunction with the accompanying drawings.

In this respect, before explaining the current embodiments of the mobilized hair-drying assembly in detail, it is to be understood that the mobilized hair-drying assembly is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mobilized hair-drying assembly.

It is therefore important that the claims be regarded as including such equivalent construction insofar as they do not depart from the spirit and scope of the mobilized hair-drying assembly. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
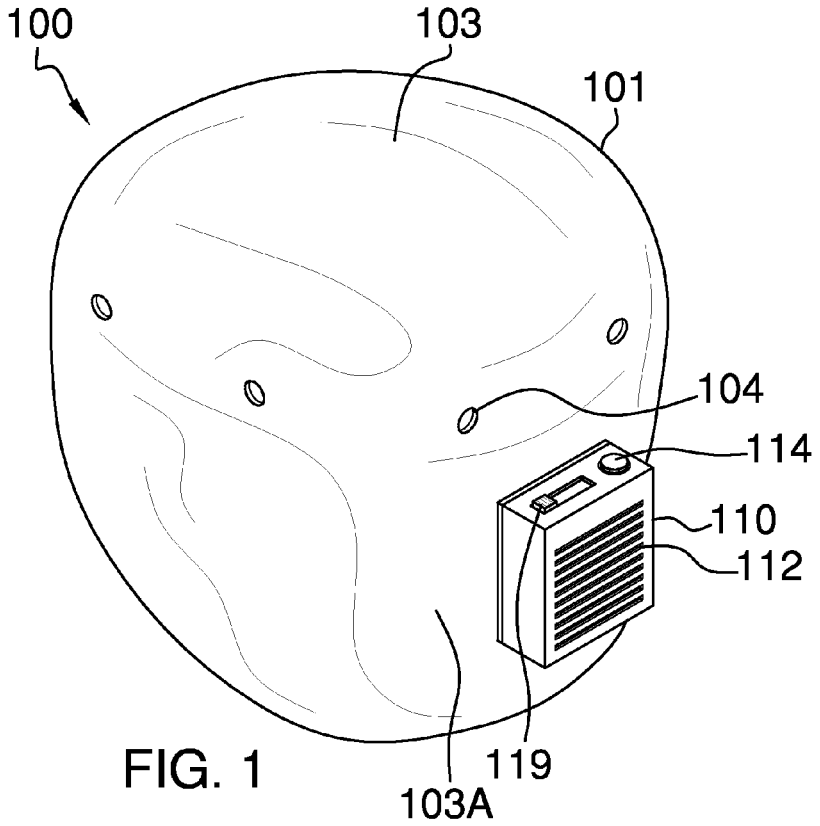
FIG. 1 is a rear, perspective view of the mobilized hair-drying assembly.
Figure 2:
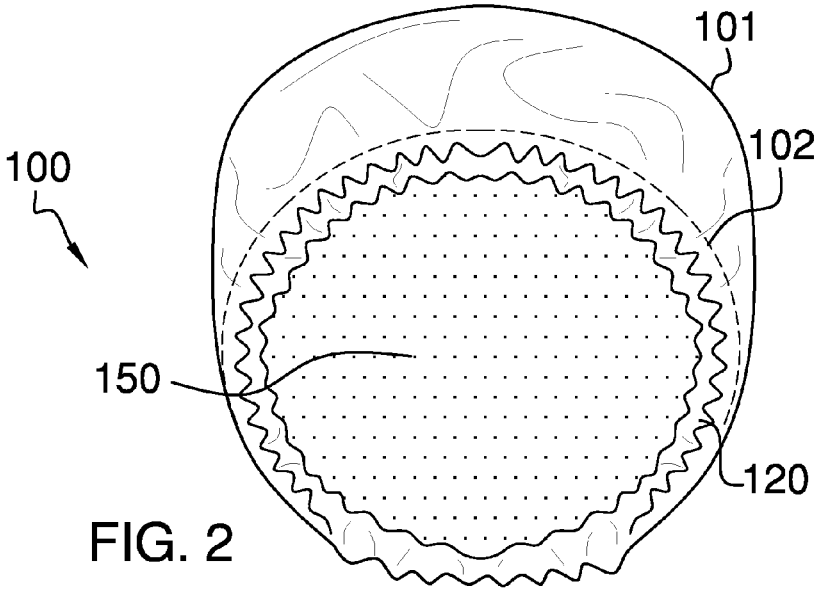
FIG. 2 is a front view of the mobilized hair-drying assembly by itself.
Figure 3:
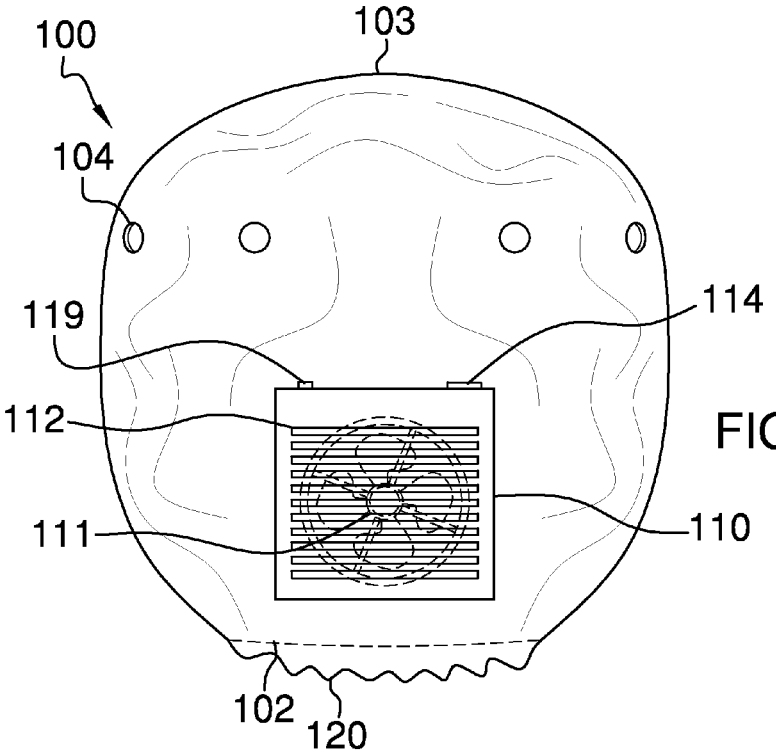
FIG. 3 is a rear view of the mobilized hair-drying assembly.
Figure 4:
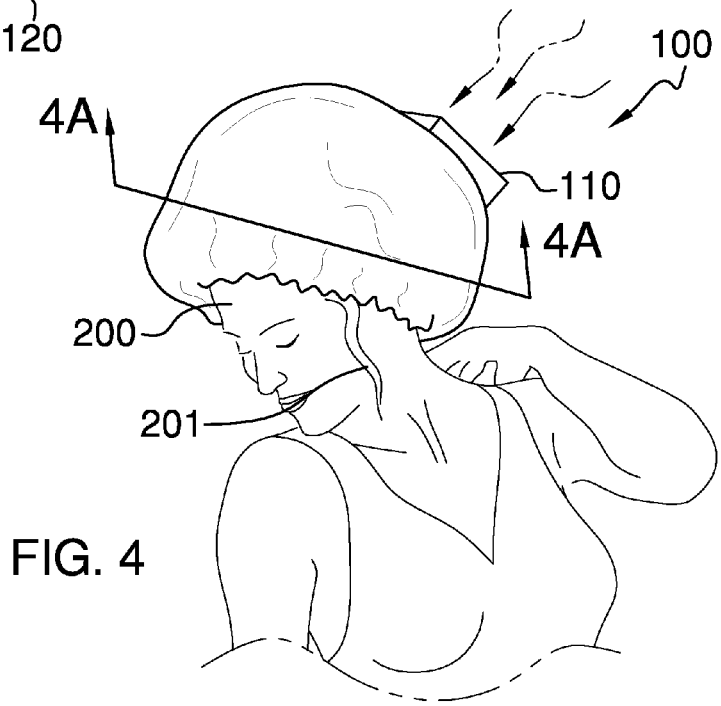
FIG. 4 is an in-use view of the mobilized hair-drying assembly.
Figure 4A:
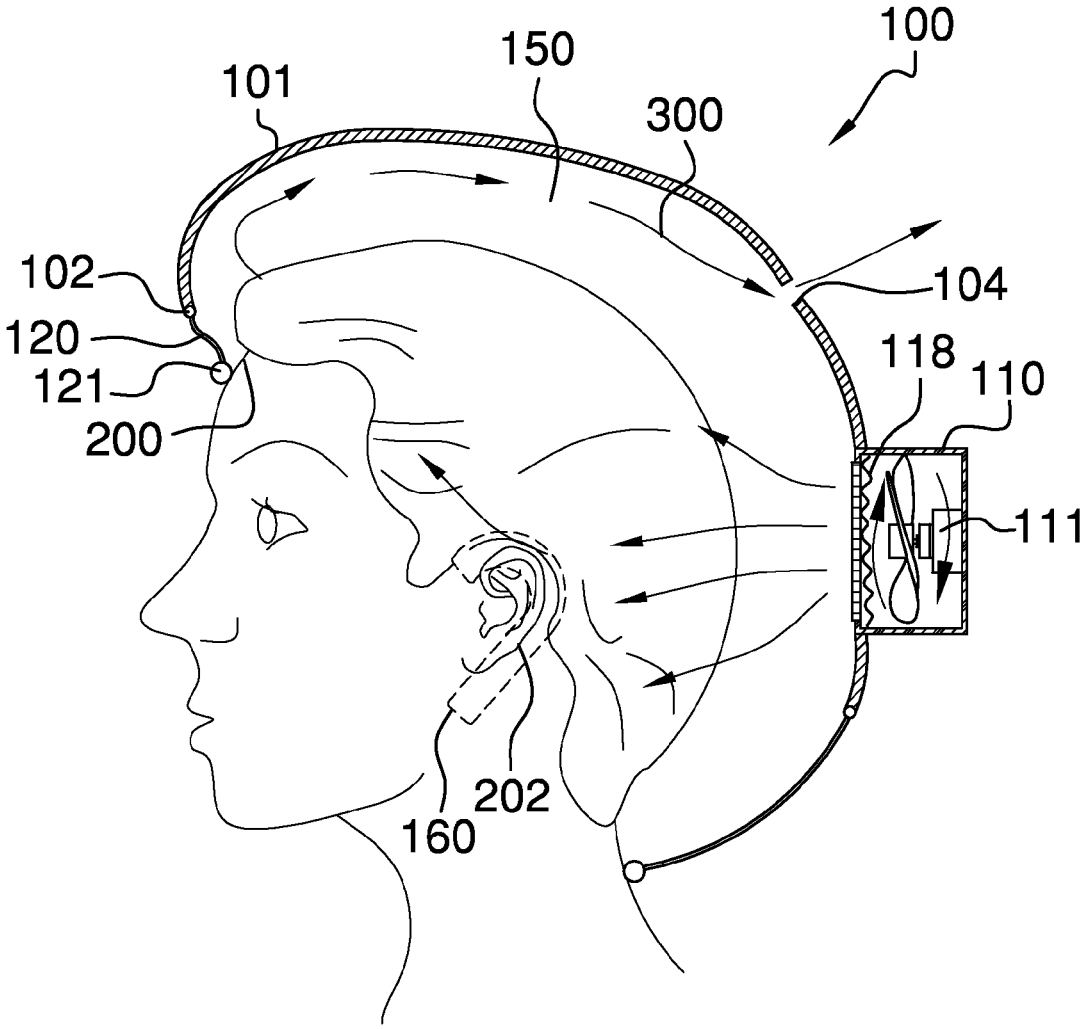
FIG. 4A is a cross-sectional in-use view of the mobilized hair-drying assembly along line 4A-4A.
Figure 5:
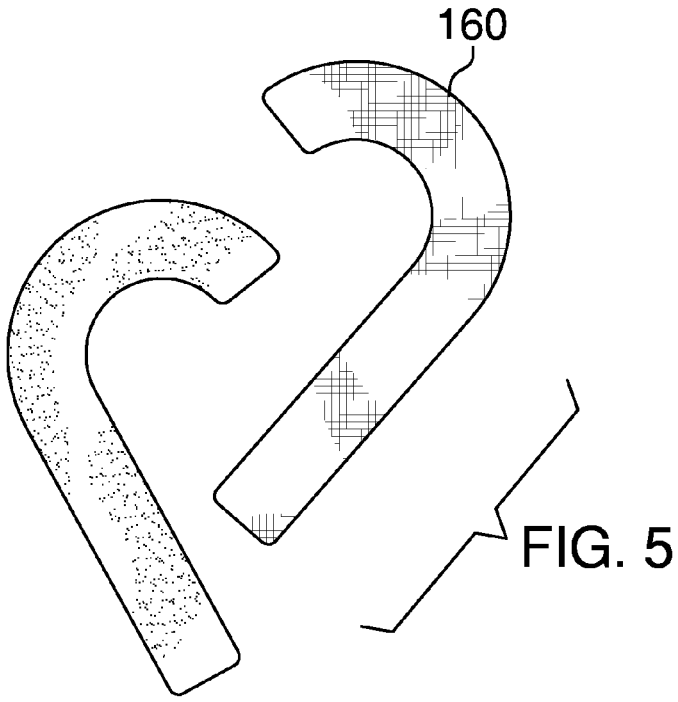
FIG. 5 is a view of ear protectors.
Figure 6:
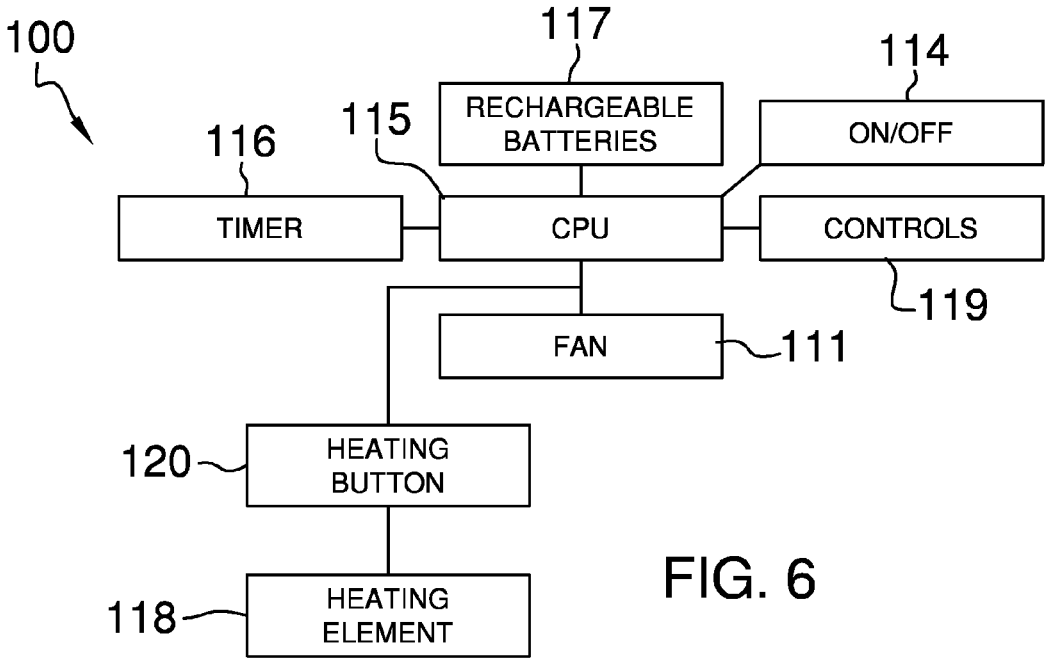
FIG. 6 is a diagram of the componentry associated with the mobilized hair-drying assembly.

As best illustrated in FIGS. 1 through 6, the mobilized hair-drying assembly 100 is further comprised of a helmet member 101 that includes an opening 102 adapted for insertion and removal of an end user's head 200. The helmet member 101 includes a motorized fan housing 110 that is integrated into the construction of an exterior surface 103 of the helmet member 101. More specifically, the motorized fan housing 110 is located at a rear surface 103A of the helmet member 101.

The helmet member 101 includes a plurality of vent holes 104 that are located at a plurality of pre-defined locations on the exterior surface 103, and which aid in enabling accelerated air to exit the helmet member 101 only after coming into contact with hair 201 of the head of the end user 200.

The helmet member 101 also includes an elastic member 120 that lines the opening 102 to form an airtight seal between the helmet member 101 and the head of the end user 200. The airtight seal formed via the elastic member 120 ensures that accelerated air 300 entering the helmet member 101 via the motorized fan housing 110 is able to come into contact with the hair 201 before exiting the helmet member 101 via the vent holes 104.

The elastic member 120 includes an elastic band 121 at a distal end, which is flexible, and able to come into contact against the head of the end user 200. The elastic member 120 is merely an extension of the opening 102 of the helmet member 101.

The motorized fan housing 110 includes a motorized fan 111 positioned between a housing inlet 112 and a housing outlet 113 so as to form the accelerated air 300, which is directed into the helmet member 101. The housing inlet 112 is located outside of the helmet member 101, and is comprised of a plurality of slots that provide fluid communication between the outside of the motorized fan housing 110 and the motorized fan 111. The housing outlet 113 is also comprised of a plurality of slots that provide fluid communication between the motorized fan 111 and an interior 150 of the helmet member 101.

The motorized fan housing 110 includes an on/off button 114, a central processing unit 115 (hereinafter CPU), a timer 116, at least one battery 117, a heating element 118, and a control member 119. The CPU 115 is in wired communication with the motorized fan 11, the on/off button 114, the timer 116, the battery 117, the heating element 118, and the control member 119. The CPU 115 is responsible for all controls associated with the operation of the assembly 100. The timer 116 enables control of the duration of use of the assembly 100, and is adjusted via the control member 119. A heating button 120 is also provided, and upon depression shall enable the heating element 118 to operate in concert with the motorized fan 111. It shall be noted that the heating element 118 is positioned adjacent the motorized fan 111 in order to heat the air that is being accelerated.

The assembly 100 may include ear protectors 160 (see FIG. 5), which are essentially candycane-shaped objects that are placed in between an ear 202 and the elastic member 120. The ear protectors 160 prevent exposure of the ears 202 to heated accelerated air 300 that is passing over the hair 201 and head of the end user 200 when the assembly 100 is in use. The ear protectors 160 may be made of a cotton or paper-based product that has a thickness ranging from ⅛ inch to not more than inch. The elastic member 120 is responsible for holding the ear protector 160 in place against the ear 202 of the head of the end user 200.

With respect to the above description, it is to be realized that the optimum dimensional relationship for the various components of the assembly 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the assembly 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mobilized hair-drying assembly comprising:

a helmet member with motorized fan directing accelerated air from outside of said helmet member into an interior where said accelerated air is configured to come across hair of an end user's head who is wearing said helmet member so as to dry hair;

wherein the helmet member is configured to dry said hair in a hands-free manner and with no tethers such that the assembly is portable;

said helmet member includes an opening adapted for insertion and removal of the end user's head;

wherein said helmet member includes a motorized fan housing that is integrated into the construction of an exterior surface of the helmet member; wherein the motorized fan housing is located at a rear surface of the helmet member;

wherein said helmet member includes a plurality of vent holes that are located at a plurality of pre-defined locations on the exterior surface, and which aid in enabling accelerated air to exit the helmet member only after coming into contact with hair of the end user's head;

wherein said helmet member also includes an elastic member that lines the opening to form an airtight seal between the helmet member and the end user's head; wherein the elastic member ensures that accelerated air entering the helmet member via the motorized fan housing is able to come into contact with the hair before exiting the helmet member via the vent holes.

2. The mobilized hair-drying assembly according to claim 1 wherein said elastic member includes an elastic band at a distal end, which is flexible, and able to come into contact against the end user's head.

3. The mobilized hair-drying assembly according to claim 2 wherein said motorized fan housing includes a motorized fan positioned between a housing inlet and a housing outlet so as to form the accelerated air, which is directed into the helmet member.

4. The mobilized hair-drying assembly according to claim 3 wherein said housing inlet is located outside of the helmet member, and is comprised of a plurality of slots that provide fluid communication between the outside of the motorized fan housing and the motorized fan.

5. The mobilized hair-drying assembly according to claim 4 wherein said housing outlet is comprised of a plurality of slots that provide fluid communication between the motorized fan and the interior of the helmet member.

6. The mobilized hair-drying assembly according to claim 5 wherein said motorized fan housing includes an on/off button, a central processing unit (hereinafter CPU), a timer, at least one battery, and a control member.

7. The mobilized hair-drying assembly according to claim 6 wherein said CPU is in wired communication with the motorized fan, the on/off button, the timer, the battery, and the control member; wherein the CPU is responsible for all controls associated with the operation of the assembly.

8. The mobilized hair-drying assembly according to claim 7 wherein said timer enables control of the duration of use of the assembly, and is adjusted via the control member.

9. The mobilized hair-drying assembly according to claim 6 wherein a heating element is located adjacent to the motorized fan, and is in wired communication with the CPU; wherein a heating button is in wired communication between the heating element and the CPU, and upon depression shall enable the heating element to operate in concert with the motorized fan.

10. The mobilized hair-drying assembly according to claim 9 wherein ear protectors are included and placed in between an ear of the end user's head and the elastic member to protect the ears from heated accelerated air.

11. A mobilized hair-drying assembly comprising:

a helmet member with motorized fan directing accelerated air from outside of said helmet member into an interior where said accelerated air is configured to come across hair of an end user's head who is wearing said helmet member so as to dry hair;

wherein the helmet member is configured to dry said hair in a hands-free manner and with no tethers such that the assembly is portable;

said helmet member includes an opening adapted for insertion and removal of the end user's head;

said helmet member includes a motorized fan housing that is integrated into the construction of an exterior surface of the helmet member; wherein the motorized fan housing is located at a rear surface of the helmet member;

said helmet member includes a plurality of vent holes that are located at a plurality of pre-defined locations on the exterior surface, and which aid in enabling accelerated air to exit the helmet member only after coming into contact with hair of the end user's head;

said helmet member also includes an elastic member that lines the opening to form an airtight seal between the helmet member and the end user's head; wherein the elastic member ensures that accelerated air entering the helmet member via the motorized fan housing is able to come into contact with the hair before exiting the helmet member via the vent holes;

said elastic member includes an elastic band at a distal end, which is flexible, and able to come into contact against the end user's head;

wherein said motorized fan housing includes a motorized fan positioned between a housing inlet and a housing outlet so as to form the accelerated air, which is directed into the helmet member;

wherein said housing inlet is located outside of the helmet member, and is comprised of a plurality of slots that provide fluid communication between the outside of the motorized fan housing and the motorized fan; wherein said housing outlet is comprised of a plurality of slots that provide fluid communication between the motorized fan and the interior of the helmet member;

wherein said motorized fan housing includes an on/off button, a central processing unit (hereinafter CPU), a timer, at least one battery, and a control member.

12. The mobilized hair-drying assembly according to claim 11 wherein said CPU is in wired communication with the motorized fan, the on/off button, the timer, the battery, and the control member; wherein the CPU is responsible for all controls associated with the operation of the assembly; said timer enables control of the duration of use of the assembly, and is adjusted via the control member; wherein a heating element is located adjacent to the motorized fan, and is in wired communication with the CPU; wherein a heating button is in wired communication between the heating element and the CPU, and upon depression shall enable the heating element to operate in concert with the motorized fan.

13. The mobilized hair-drying assembly according to claim 12 wherein ear protectors are included and placed in between an ear of the end user's head and the elastic member to protect the ears from heated accelerated air.

* * * * *